US010037682B1

(12) United States Patent
Shah et al.

(10) Patent No.: US 10,037,682 B1
(45) Date of Patent: Jul. 31, 2018

(54) SYSTEMS AND METHODS FOR REMOTELY ACTIVATING AN EMERGENCY PROTOCOL

(71) Applicant: Google Inc., Mountain View, CA (US)

(72) Inventors: Rohan Shah, Sunnyvale, CA (US); Thad Eugene Starner, Atlanta, GA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 14/817,697

(22) Filed: Aug. 4, 2015

(51) Int. Cl.

| | |
|---|---|
| ***G08B 25/10*** | (2006.01) |
| ***G08B 25/12*** | (2006.01) |
| ***G08B 25/01*** | (2006.01) |
| ***G08B 21/02*** | (2006.01) |

(52) U.S. Cl.
CPC ..... *G08B 25/10* (2013.01); *G08B 21/02* (2013.01); *G08B 25/016* (2013.01); *G08B 25/12* (2013.01)

(58) Field of Classification Search
CPC ..... G08B 25/10; G08B 25/12; G08B 25/016; G08B 21/02; H04W 4/22; H04W 76/007
See application file for complete search history.

(56) References Cited

U.S. PATENT DOCUMENTS

| | | | | |
|---|---|---|---|---|
| 5,627,520 | A | 5/1997 | Grubbs et al. | |
| 8,565,717 | B2 * | 10/2013 | Galuszka | G08B 25/016 340/537 |
| 2012/0282877 | A1 * | 11/2012 | Amis | H04W 4/22 455/404.1 |
| 2015/0065076 | A1 * | 3/2015 | Kim | H04W 76/007 455/404.1 |
| 2015/0279197 | A1 * | 10/2015 | Said | G08B 21/02 340/573.1 |
| 2015/0279199 | A1 * | 10/2015 | Yarkoni | G08B 25/016 340/539.11 |

* cited by examiner

*Primary Examiner* — Mohamed Barakat
(74) *Attorney, Agent, or Firm* — Shumaker & Sieffert, P.A.

(57) ABSTRACT

A system, method, and device are provided for activating an emergency protocol when a weak point on a user device is compromised as a result of an applied stress. The system comprises the user device and its relationship with a network element. When the weak point on the user device undergoes stress and breaks, a distress signal is sent to the network element. The network element then proceeds to activate the emergency protocol which may include placing a call to an emergency response team.

11 Claims, 10 Drawing Sheets

SYSTEMS AND METHODS FOR REMOTELY ACTIVATING AN EMERGENCY PROTOCOL

BACKGROUND

Emergency situations normally warrant a responsible party to alert others by using their telephone or mobile device and placing a call. In some instances, the mobile device or telephone may be out of reach when the individual in an emergency needs the device. In other situations, the individual may have lost their mobile device. In these situations, the individual must find other ways to inform responsible parties of their current predicament. This problem is alleviated somewhat with home security systems where a company is responsible for remotely monitoring the home in order to alert police or firefighters. The home security system unfortunately does not extend beyond the home environment. In certain instances, even within the home, the individual needs to remember to turn on the alarm system in order for the home security system to be effective.

BRIEF SUMMARY

One embodiment of the disclosure provides a system for activating an emergency protocol. The system includes a network element that contains at least a receiver configured to receive a distress signal, a storage unit configured to hold parameters pertaining to the emergency protocol, and a processor configured to activate the emergency protocol in response to receiving the distress signal. The system also includes a user device communicably coupled with the network element over a wireless connection. The user device includes a housing, a deliberate weak point or fragile location on the housing that is designed to break when a stress exceeding a predetermined stress threshold is applied, a detection circuit configured to determine whether the weak point is broken, and a transmitter configured to send the distress signal to the network element over the wireless connection in response to a signal from the detection circuit indicating that the weak point is broken. In certain aspects, the emergency protocol includes taking an action such as placing a call by the network element.

Another embodiment of the disclosure provides a method of generating a distress signal on an electronic device. The method includes placing the electronic device in a dormant or sensing mode and then determining, with the electronic device, whether a trigger event has occurred. In certain aspects, a trigger event occurs when a weak point on the electronic device breaks due to applied stress exceeding a predefined stress level. If the electronic device determines that a trigger event has occurred, then the electronic device establishes a wireless connection between the electronic device and a preconfigured device. The method further includes sending, by the electronic device, a distress signal to the preconfigured device to enable the preconfigured device to implement an emergency protocol.

Yet another embodiment of the disclosure provides an electronic device for generating a distress signal. The electronic device includes a sensor housing that has a weak point or fragile location, a battery, a transmitter, a receiver, and a detection circuit. The detection circuit includes a sensor circuit that is coupled to a control circuit. The sensor circuit designed to sense a break at the weak point on the sensor housing, and the control circuit is configured to activate the transmitter in response to the sensor circuit sensing the break at the weak point. The transmitter and the receiver are configured to establish a connection to a preconfigured device, and the transmitter is further configured to send the distress signal to the preconfigured device to cause the preconfigured device to implement an emergency protocol.

DETAILED DESCRIPTION

Figure 1A:
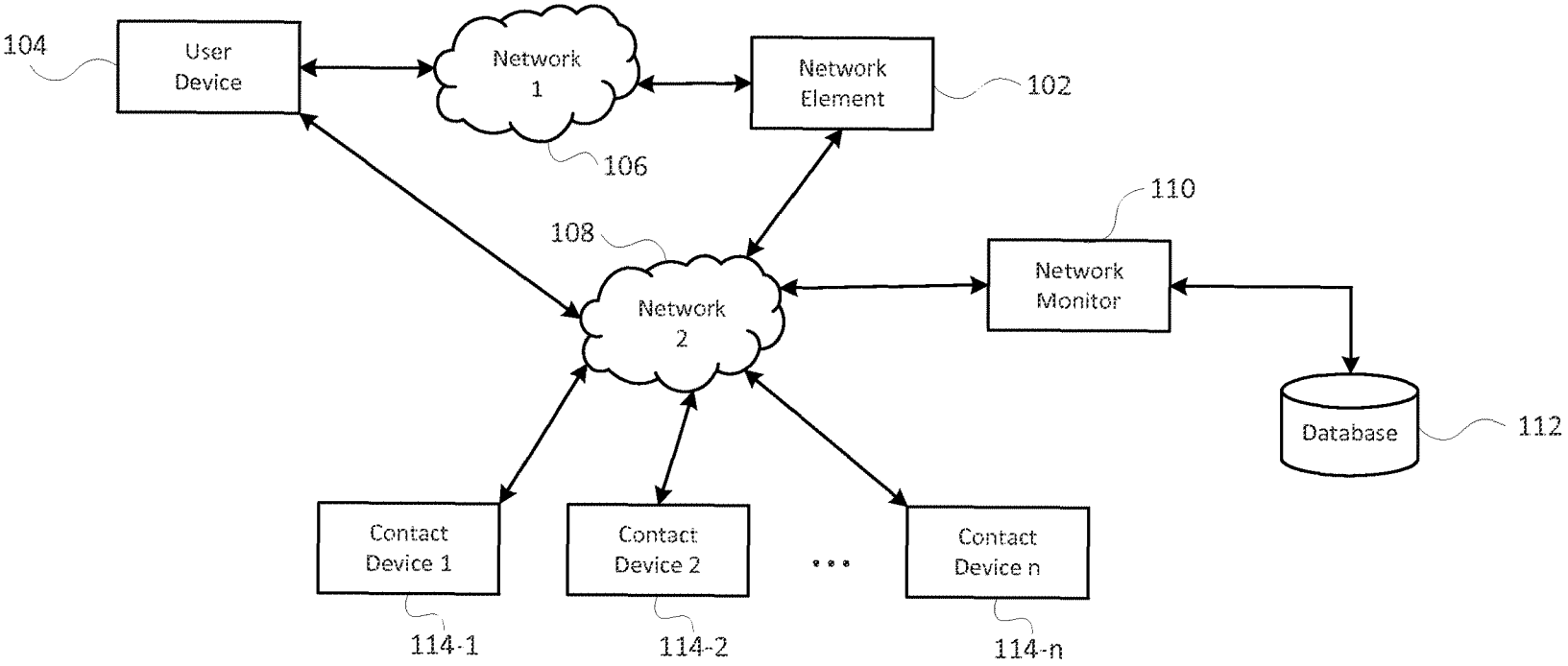
FIG. 1A is a block diagram illustrating a system in accordance with some example embodiments.

The present disclosure generally relates to methods and systems for remotely activating an emergency protocol, and more particularly for generating a distress signal in response to a physical break in a user device. According to various embodiments, the user device is purposefully designed to have a weak point or fragile location on its housing. The housing is therefore configured to break at the location of the weak point when a stress applied exceeds a predetermined stress level. Having a user device break at a certain location reduces the complexity of the sensing mechanisms necessary to determine if the device is compromised. By reducing the complexity of sensing, costs associated with sensing the breakage may also be reduced. In certain instances, costs are both financial costs and energy costs. Financial costs may be reduced by concentrating sensing circuits to the weak point on the device, in contrast to implementations that provide sensing circuits throughout the entire device. Energy costs may be reduced in certain instances because sensing circuits concentrated to the weak point will be less complex than introducing a network of sensors throughout a device in order to determine whether the device has been compromised.

In certain embodiments, in addition to having a weak point on a user device, the device is equipped with various electronic and/or mechanical components that provide a status of the weak point. For example, the user device may be equipped with a sensor that senses when the weak point has been compromised. In certain aspects, the sensor includes an electronic circuit. In other aspects, the sensor includes one or more magnetic components. In various other situations, the sensor may include one or more mechanical components. In addition, various other embodiments may combine magnetic sensing elements with electrical and mechanical sensing elements. The sensor is discussed as a single component, but the user device may incorporate a plurality of sensors for the described functionality.

In certain embodiments, the weak point on a user device with a sensing element is electronically coupled to a control circuit that reacts to a status of the weak point. For example, the control circuit may receive a signal from the sensor indicating that the weak point has been compromised, and in response to this signal, the control circuit performs various functions on the user device. In some aspects, the signal is relayed through a normally open switch closing when the weak point is compromised. In certain aspects, a normally closed switch is configured to be open, and when the weak point is compromised, the normally closed switch returns to its default closed state allowing the signal to be relayed. In certain embodiments, the user device is equipped with a transmitter to allow the control circuit to transmit a response signal or a distress signal when the weak point is compromised. In certain aspects, the transmitter transmits radio frequency (RF) signals compatible with one or more wireless transmission technologies. In addition to or instead of a transmitter, the user device may be equipped with a speaker, and the control circuit causes the speaker to emit sound waves when the weak point is compromised. The sound waves emitted may be ultrasonic.

As shown in FIG. 1A, certain aspects of the invention include a user device with a weak point that is coupled to a network element. The network element is configured to receive a distress signal when the weak point is compromised. The user device may be equipped with a transmitter to transmit the distress signal, and the network element equipped with a receiver to receive the distress signal. In certain instances, the user device may send the distress signal to the network device through a wired connection that exists between both devices. Additionally, certain aspects of the disclosure may utilize a capacitive coupling between both devices to transmit the distress signal.

In certain embodiments, a network element that receives a distress signal from a user device with a weak point activates an emergency protocol that results in the network element engaging in one or more activities. Examples of these one or more activities include the network element attempting to contact other parties by placing a voice or video call, recording ambient audio and/or video and sending this information to other parties, relaying GPS (Global Positioning System) information to other parties, etc.

In certain aspects of the disclosure, a network monitor is configured to capture some aspects of the one or more activities that a network element may perform in response to receiving a distress signal from a user device with a weak point. For example, a network monitor may capture the Internet Protocol (IP) address of the network element and/or the last location of the network element. Additionally, a network monitor may be configured to capture a distress signal from a user device with a weak point. For example, the network monitor may record the location of the distress signal and further track the movement of the distress signal. In some embodiments, the network monitor is configured to relay the distress signal to a network element after discovering that the network element is not in proximity to receive the distress signal from the user device.

In certain embodiments, a network element may be interrupted while engaging in the one or more activities in response to receiving a distress signal from a user device with a weak point. The network element may be configured to receive a PIN or passcode that quells the one or more activities. For example, recording and sending audio in response to receiving the response signal from the user device is stopped by entering a passcode on the network element. Additionally, a text message clarifying that a false alarm had occurred may be sent by the network element to one or more devices.

Figure 1B:
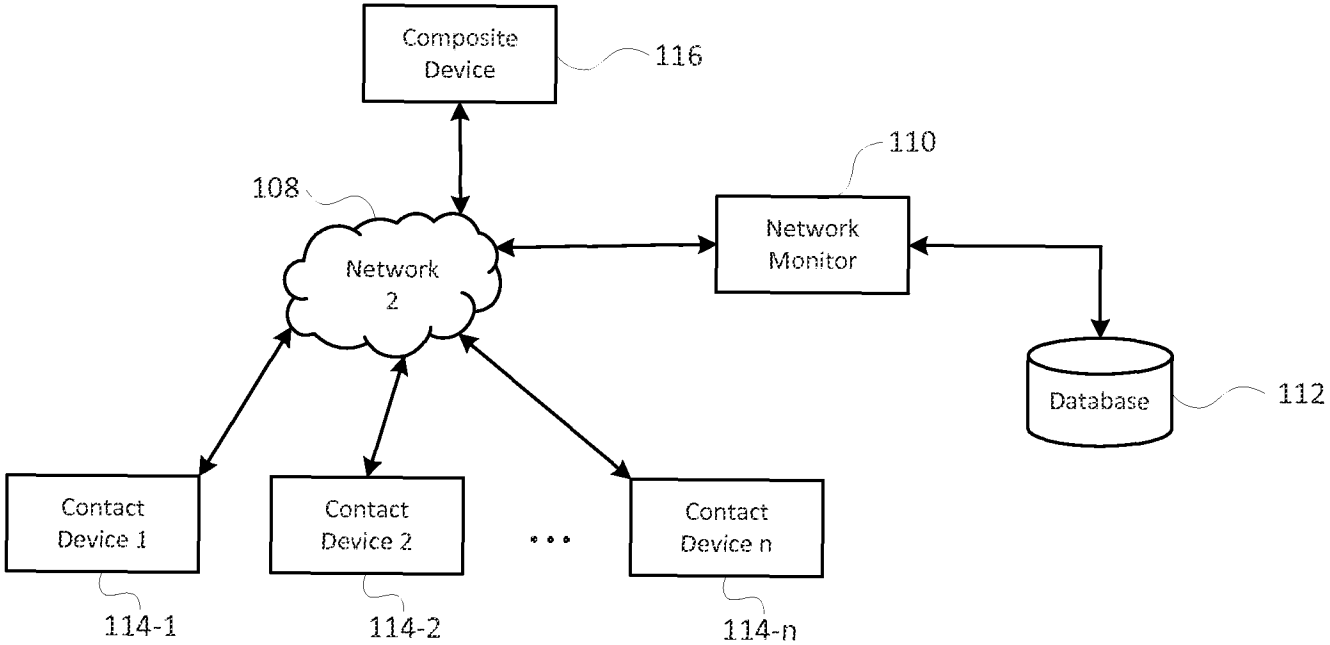
FIG. 1B is a block diagram illustrating the system when the functions of a user device, network, and network element in the system of FIG. 1A are performed by a composite device.

In certain embodiments, a user device and a network element may be combined and placed in one device (FIG. 1B). For example, a user device and a network element may exist on a smartwatch, a smart band, or a fitness band. In certain aspects, a smartwatch is designed to have a weak point on its strap that when pulled, the strap will break at the designated location. When the strap breaks at the designated location, the smartwatch engages in one or more activities. In another smartwatch scenario, the user device and the network element may be placed on separate devices. A user device may be placed on a smartwatch or a strap of a conventional watch (analog or digital), and the network element may be a smartphone. In the event the weak point on the strap of the smartwatch or the strap of the conventional watch is compromised, a distress signal is sent to the smartphone. The smartphone then engages in one or more activities already provided. In certain aspects, the network monitor is an internet service provider, a mobile network carrier, etc.

FIG. 1A is a block diagram illustrating a system 100 in accordance with certain embodiments of the disclosure. The system 100 includes a network element 102, a user device 104, a network connection 106, another network connection 108, and one or more contact devices 114-1 through **114-*n*. One or more network monitors 110 with access to one or more databases 112 may be included. FIG. 1B provides a variation to system 100 in accordance with certain embodiments of the disclosure. System 100 may further include a composite device 116 which possesses the functionality of user device 104, network 106, and network element 102**.

The network element 102 may be any type of communication device that supports network connectivity, including a mobile phone, a smart phone, a personal computer, a laptop computer, a smartwatch, a smart television, a video game system, a personal digital assistant (PDA), a wearable or embedded digital device, automobile communication system, etc. In certain embodiments, network element 102 may support multiple types of networks. For example, network element 102 may have WiFi connectivity allowing both voice and video calls over IP or may have mobile network connectivity allowing voice and video calls over cellular and data network. In certain aspects, network element 102 may be equipped with microphones configured to receive a distress signal through sound waves.

Figure 2A:
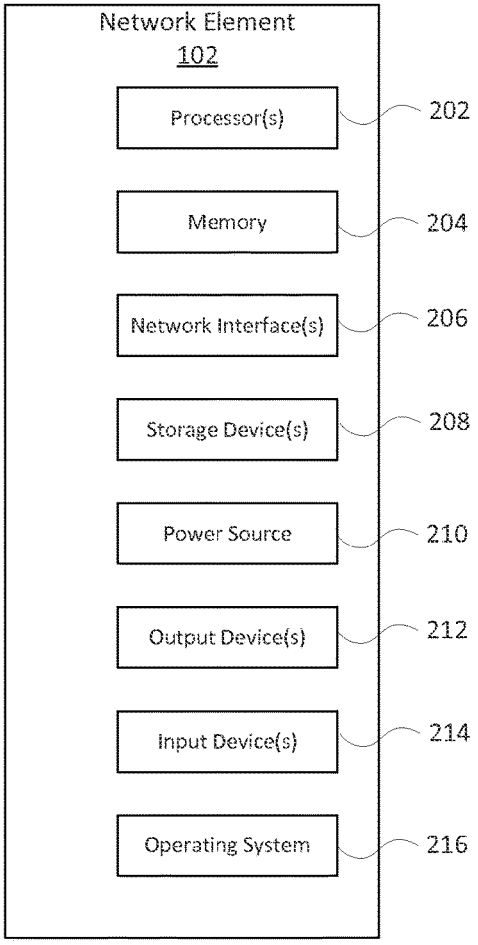
FIG. 2A is a block diagram illustrating components of a network element from the system illustrated in FIG. 1A according to some example embodiments.

FIG. 2A is a block diagram illustrating components of network element 102 from the system illustrated in FIG. 1A according to some example embodiments. In the illustration of FIG. 2A, the network element 102 includes one or more processors 202, memory 204, network interfaces 206, storage devices 208, power source 210, one or more output devices 212, and one or more input devices 214. An operating system 216 is configured to run on the provided hardware, ensuring that each of the components including the processor 202, memory 204, network interfaces 206, storage devices 208, power source 210, output devices 212, and input devices 214 is interconnected physically, communicatively, and/or operatively for inter-component communications.

As illustrated, processor 202 is configured to implement functionality and/or process instructions for execution within the network element 102. For example, processor 202 executes instructions stored in memory 204, instructions stored on a storage device 208, or instructions managed by the operating system 216 which may be fully or partly loaded to memory 204 or storage device 208. Memory 204, which may be a non-transient, computer-readable storage medium, is configured to store information within network element 102 during operation. In certain embodiments, memory 204 includes both volatile and non-volatile memory, where the non-volatile memory maintains its contents when network element 102 is turned off. Examples of such non-volatile memory include flash memory, read only memories (ROM), electrically erasable programmable read-only memory (EEPROM), resistive random access memory (RRAM), etc. Examples of volatile memories that lose their contents when network element 102 is turned off include random access memories (RAM), dynamic random access memories (DRAM), and static random access memories (SRAM). Memory 204 also maintains program instructions for execution by the processor 202.

Storage device 208 also includes one or more non-transient computer-readable storage media. The storage device 208 is generally configured to store larger amounts of information compared to memory 204. The storage device 208 may further be configured for long-term storage of information and may be configured to store pertinent files for the operating system 216. In some embodiments, the storage device 208 includes non-volatile storage elements. Examples of non-volatile storage elements include magnetic hard discs, solid state drives, optical discs, floppy discs, flash memories, other forms of EEPROM and electrically programmable read-only memories (EPROM), and other variants of RRAM.

Network element 102 uses network interface 206 to communicate with external devices via one or more networks (see FIG. 1A). Network interface 206 may be a network interface card, such as an Ethernet card, an optical transceiver, a radio frequency transceiver, or any other type of device that can send and receive information. Examples of network interfaces 206 include Bluetooth® radios, 3G radios, 4G radios, radios compatible with Ka or Ku satellite bands, WiFi radios, Universal Serial Bus (USB), ANT compatible radios, ZigBee compatible radios, Thread compatible radios, near field communication radios, ultra-wide band compatible radios, radios compatible with frequencies (e.g., from about 80 MHz to about 150 MHz) that tend to wrap around the human body, and personal area network interfaces that are designed to send data over the human body. See, Zimmerman, Thomas G., "Personal Area Networks (PAN): Near-Field Intra-Body Communication," M.S. Thesis, Massachusetts Institute of Technology, 1995, for a discussion regarding personal area networks.

Network element 102 includes one or more power sources 210. Non-limiting examples of power source 210 include single-use power sources, rechargeable power sources, and/or power sources developed from nickel-cadmium, lithium-ion, or other suitable materials.

Network element 102 may include one or more output devices 212. Output devices 212 are configured to provide output to a user using tactile, audio, and/or video stimuli. Output device 212 may include a display screen, a sound card, a video graphics adapter card, or any other type of device for converting a signal into an appropriate form understandable to humans or machines. Additional examples of output device 212 includes a speaker such as headphones, a cathode ray tube (CRT) monitor, a liquid crystal display (LCD), or any other type of device that can generate intelligible output to a user or machine. In certain aspects, output device 212 includes a speaker for generating ultrasonic sound waves or audible sound waves for device to device communication. The audible sound wave generated may be an alarm to warn or direct attention to network element 102.

Network element 102 may include one or more input devices 214. Input devices 214 are configured to receive input from a user or surrounding environment of the user through tactile, audio, and/or video feedback. Non-limiting examples of input device 214 include a presence-sensitive screen, a mouse, a keyboard, a voice responsive system, a video camera, a microphone, or any other type of input device. In some examples, the presence-sensitive screen includes a touch-sensitive screen. Input device 214 may include a microphone or other sound wave sensor configured to receive ultrasonic or audible sound waves for device to device communication. Processor 202 may execute instructions loaded to memory 204 to recognize an audible tone captured by the microphone. In certain aspects, processor 202 along with memory 204 work to determine whether the microphone is picking up a known ultrasonic sound wave signature.

With the aforementioned components in network element 102, the network element 102 may provide various other services. For example, network element 102 may have a network interface 206 that includes a GPS transceiver used to determine a geographic location of the network element 102. Additionally, geographic location may be determined using a state of the processor 202, which is defined by a series of instructions stored on memory 204 or storage device 208 that when executed cause the processor 202 to triangulate a geographic location of the network element 102 based on any available network connections.

In certain aspects of the disclosure, user device 104 is communicatively coupled to network element 102 through network 106. Network 106 represents a connectivity methodology and may take the form of multiple topologies. For example, network 106 may be a wireless network or a wired network. In certain embodiments, network 106 may support RF communication utilizing Bluetooth®, Bluetooth® Low Energy (LE), ANT, ZigBee, Thread, radio frequencies (e.g., from about 80 MHz to about 150 MHz) that can wrap around the human body, WiFi, ultra-wideband (UWB), and near field communication (NFC). In certain aspects, network 106 may support sound communication utilizing audible sound waves or ultrasonic sound waves. In some embodiments, network 106 supports communication through capacitive coupling. Communication through capacitive coupling may include transmitting alternating current between user device 104 and network element 102. Additionally, network 106 may support communication through personal area networks, which includes transmitting signals through the human body also known as intrabody communication.

Figure 2B:
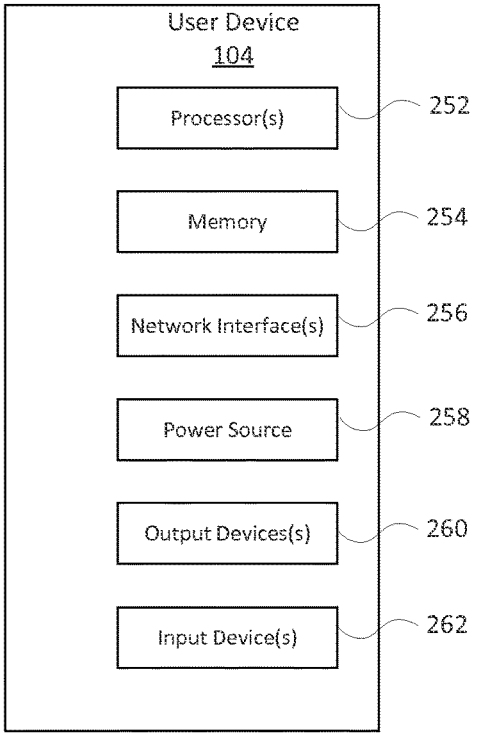
FIG. 2B is a block diagram illustrating components of a user device from the system illustrated in FIG. 1B according to some example embodiments.

FIG. 2B provides a block diagram illustrating components of a user device 104 from the system illustrated in FIG. 1A according to some example embodiments. User device 104 includes one or more processors 252, memory 254, network interfaces 256, and power source 258. User device 104 may include output devices 260 and input devices 262. Each of the components including the processor 252, memory 254, network interface 256, power source 258, output devices 260, and input devices 262 is interconnected physically, communicatively, and/or operatively for inter-component communication.

As illustrated, processor 252 is configured to implement functionality and/or process instructions for execution within the user device 104. For example, processor 252 executes instructions stored in memory 254. Memory 254 is analogous to memory 204 and may be a non-transient, computer-readable storage medium, configured to store information within user device 104 during operation. In certain embodiments, the processor 252 and memory 254 are implemented as a control circuit or a super unit incorporating the functions of both processor 252 and memory 254. A motivation for this combination may be to reduce power consumption by utilizing application specific integrated circuits (ASICs). In certain aspects of the disclosure, the functionality of a control circuit that can react to sensing inputs are much more important than the specific implementation or demarcation between functionality prescribed to processor 252 or those prescribed to memory 254.

User device 104 provides one or more network interfaces 256 for communication with external devices via one or more networks as depicted in FIG. 1A. In certain embodiments, user device 104 only has access to network 106, and network interface(s) 256 provides a communication interface to network 106 in order to facilitate communication to network element 102. Network interface(s) 256 may be a network interface card, such as an Ethernet card, an optical transceiver, a radio frequency transceiver, or any other type of device that can send and receive information. Non-limiting examples of network interface(s) 256 include Bluetooth® radios, 3G radios, 4G radios, commercial mobile carrier radios like LTE radios, WiFi radios, Universal Serial Bus (USB), ANT compatible radios, ZigBee compatible radios, Thread compatible radios, near field communication radios, ultra-wide band compatible radios, radios compatible with frequencies (e.g., from about 80 MHz to about 150 MHz) that can wrap around the human body, and personal area network interfaces that are designed to send data over the human body. In certain embodiments, user device 104 may have network interface(s) 256 that provide access to multiple networks as illustrated in FIG. 1A. Network interface(s) 256 may provide support for at least one type of network in this configuration depending on the protocol used for network communication. For example, network 106 may support Bluetooth® LE communication, and network 108 may support cellular network communication, so network interface(s) 256 should be able to support both networks.

User device 104 includes one or more power sources 258. Power source 258 in user device 104 may be designed to only provide power when the weak point on the user device 104 is compromised. Non-limiting examples of power source 258 include single-use power sources, rechargeable power sources, and/or power sources developed from nickel-cadmium, lithium-ion, or other suitable material. Rechargeable power sources may be compatible with inductive chargers. In certain embodiments, power source 258 includes circuits that enable energy scavenging and a battery to store the scavenged energy. In some aspects, the battery may be charged with ambient-radiation sources, for example, ubiquitous RF energy or ambient light sources. In certain aspects, the battery may be charged using thermoelectric conversion or thermal radiance where energy is obtained from a temperature difference. The battery may be charged with vibrational excitations, for example, vibrations of floors, walls, human movement. In certain embodiments, these energy scavenging techniques are utilized without the need of a battery. A storage capacitor may be used to temporarily store the harvested energy. Additionally, these energy harvesting techniques may incorporate springs that pulse microgenerators, moving magnets or coils, microelectromechanical systems (MEMS) and nanoelectromechanical systems (NEMS) technology.

User device 104 may include output devices 260. Output devices 260 are configured to provide output to user using tactile, audio, and/or video stimuli. Output devices 260 are analogous to output devices 212 already introduced. In certain aspects, output devices 260 includes one or more speakers for generating ultrasonic sound waves or audible sound waves for device to device communication. Additionally, the audible sound wave generated may be an alarm to warn or direct attention to the user device 104.

User device 104 may include input devices 262. Input device(s) 262 is configured to receive input from a user or surrounding environment of the user through tactile, audio, and/or video feedback. Input device(s) 262 is analogous to input device 214 of network element 102. In certain aspects, input devices 262 comprise sensors and sensing circuitry that determine the status of a weak point on the user device 104. The sensing circuit may be configured to sense a change in resistance, capacitance, or inductance. The sensing circuit may be configured as an active sensing circuit that monitors the status of the weak point for specified intervals, for example, the sensing circuit may check the status of the weak point every 5 seconds. In certain aspects, this interval is not a constant interval and may be influenced through instructions executed at processor 252. On the other hand, the sensing circuit may be configured as a passive sensing circuit that does not consume power until the weak point is compromised. For example, the sensing circuit may incorporate a normally closed switch configured to an open state in order to impede current flow, and when the weak point is compromised, the normally closed switch closes, providing a path for current flow.

Input devices 262 may further include external sensors that monitor the environment of user device 104. These external sensors may be coils used to determine what is proximate to user device 104. For example, the sensors or coils may be used to determine if user device 104 is near flesh, wood, or if user device 104 is immersed in a liquid or gas medium. In certain aspects, these coils are used to determine whether a false alarm has occurred after sensing a break in the weak point of user device 104. In certain aspects, the sensors or coils determine whether to respond to a break in the weak point of user device 104. When a user device 104 is moved away from the human body and the weak point is intact, user device 104 deactivates sensing or monitoring the weak point. For example, sensors, configured in the current manner, may be used to enable sensing or monitoring the weak point only in the vicinity of human flesh. Additionally, user device 104 may include accelerometers that are used to determine device orientation as well as location information.

In certain embodiments, as illustrated in FIG. 1B, composite device 116 may encompass the functionality of user device 104, network 106, and network element 102. Composite device 116 may be made from the different components provided for user device 104 and network element 102. Since composite device 116 is only one electronic device, network 106 may be a wired connection or one or more busses for transferring control and data information between the functional parts of composite device 116.

Turning back to FIG. 1A, contact devices 114-1 through **114-*n* are shown to possess the ability of being communicatively coupled to at least one of user device 104 and network element 102. Similar components shown in FIG. 2A to be included in the network element 102 can also be included in contact devices 114-1 through 114-*n***.

According to certain embodiments, network monitor 110 is a server or plurality of servers that contain similar components as shown for network element 102 in FIG. 2A. Network monitor 110 has access to one or more databases 112. Network monitor 110 has one or more capabilities, for example, network monitor 110 may be configured to determine GPS (Global Positioning System) and other location information and Internet Protocol (IP) information of user device 104, network element 102, or composite device 116. Network monitor 110 may be configured to capture service set identification (SSID) information from user device 104, network element 102, or composite device 116, and use the SSID information to determine a location of one or more of the devices. Additionally, network monitor 110 may be configured to provide a route or path taken by at least one of user device 104, network element 102, and composite device 116. Network monitor 110 may relay signals from user device 104 to network element 102, and from network element 102 to user device 104. Additionally, Network monitor 110 may relay a distress signal from user device 104 to network element 102. Examples of network monitor 110 include a server device or a plurality of server devices of an internet service provider, a mobile network carrier, a security firm, or a telecommunications company. Private mobile WiFi networks on UPS trucks, Fedex trucks, taxis, law enforcement vehicles, or Greyhound buses may provide additional avenues to relay the distress signal from user device 104 to network element 102. Additionally, satellite services such as Argos may pick up the distress signal and relay the signal to one or more other networks.

The following discussions further illustrate certain aspects of the disclosure but should not be construed as in any way limiting its scope. In the ensuing embodiments, sample devices will be used to demonstrate exemplary attributes of user device 104, network element 102 and composite device 116.

Figure 3A:
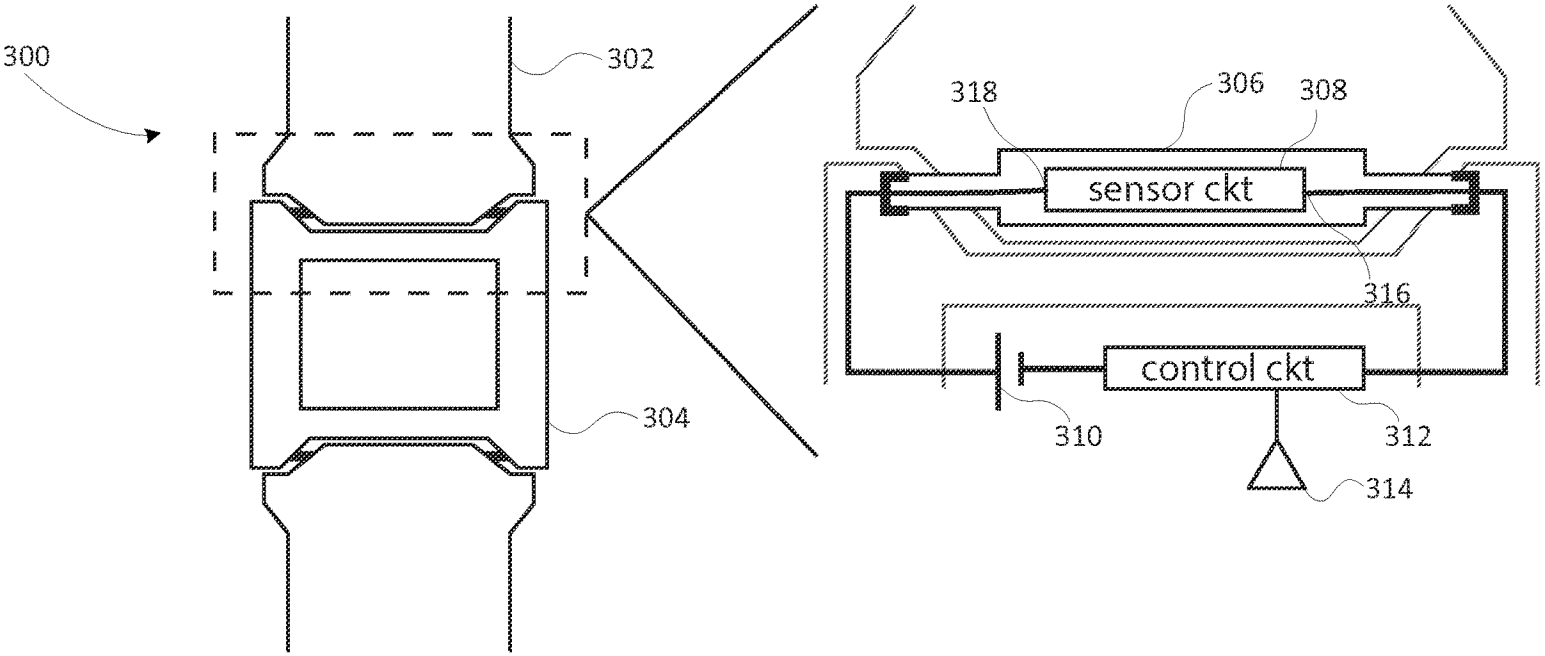
FIG. 3A is an illustration of components of a smartwatch in accordance to some example embodiments.

FIG. 3A provides an example of composite device 116 according to various embodiments of the disclosure. Composite device 116 is presented as a smartwatch 300. The smartwatch 300 includes a strap 302 and a watch body 304. In accordance with certain embodiments of the disclosure, an alternate view showing a block diagram of the components beneath the exterior of strap 302 and watch body 304 is provided as well. The watch pin 306 connects the strap 302 to watch body 304. In certain aspects, the weak point on the smartwatch 300 is on watch pin 306. Watch pin 306 includes a sensor circuit 308 configured to sense when the watch pin 306 is broken or compromised. Smartwatch 300 further includes a power source 310, control circuit 312, and antenna 314. Functional components of smartwatch 300 are provided in FIG. 3A, but as previously discussed, functionality of control circuit 312 may be realized in the memory (not shown) and processor (not shown) of smartwatch 300.

In certain embodiments, sensor circuit 308 provides a preconfigured resistance between points 316 and 318, and sensor circuit 308 is configured to communicate the resistance between points 316 and 318 to control circuit 312. For example, the resistance may be a low resistance or a high resistance. In the event pin 306 breaks, the change in this resistance is determined by control circuit 312, which is configured to activate an emergency protocol. Additionally, control circuit 312 may be configured to activate the emergency protocol when sensor circuit 308 does not provide resistance information within a certain time window. This method of sensing is an active sensing method as previously discussed.

Piezo materials, when deformed, give off charge. In certain aspects of the disclosure, sensing circuit 308 may incorporate piezo materials that give off charge when watch pin 306 is compromised. The charge given off by the sensing circuit 308 is provided to control circuit 312.

A normally closed switch completes a circuit when there is no pressure on its button. In certain embodiments, watch pin 306 does not house sensor circuit 308, but instead pushes on a normally closed switch which is embedded in watch body 304. As long as watch pin 306 is not compromised, the normally closed switch will have a mechanical pressure (from watch pin 306) that keeps the normally closed switch depressed. The normally closed switch in its depressed state is in an open configuration, rendering the circuit open. When the watch pin 306 is broken, the mechanical pressure is removed, and the normally closed switch is no longer pressed in. By returning to its normal closed state, the normally closed switch completes the circuit that triggers an emergency protocol. The circuit in this case consumes no power until the switch is closed, that is, until the weak point is broken. The normally closed switch in this case serves as a mechanical sensor coupled to the control circuit 312. When the weak point on watch pin 306 is broken, and watch pin 306 is no longer in the position to press the normally closed switch, the closing of the normally closed switch is the event that enables control circuit 312 to activate the emergency protocol.

FIG. 3A provides a block diagram where watch pin 306 connecting the strap 302 to the watch body 304 is the weak point. In certain embodiments, strap 302 is made of multiple links and pins, and therefore, the weak point and the circuitry provided may be placed in any of the pins and links on smartwatch 300. In certain aspects, the smartwatch 300 may be viewed as a user device 104 and paired with a smartphone (not shown) operating as a network element 102.

Yet in certain embodiments, the strap may be flexible, capable of stretching beyond its manufactured length. In some aspects, the breaking of the weak point constitutes stretching the strap past its point of elasticity. When utilizing a flexible strap, sensor circuit 308 may be incorporated around pin 306 so that when the strap is stretched beyond its elastic limit, a spacing is created between the pin and the strap that changes the reading that the sensor circuit 308 provides to control circuit 312. In certain aspects, a conductive thread may be woven into the watch strap, and stretching the watch strap past a certain length breaks the conductive thread which eventually is sensed and provided to control circuit 312. In certain aspects, the conductive thread may be realized with elastic resistors or other methods.

Figure 3B:
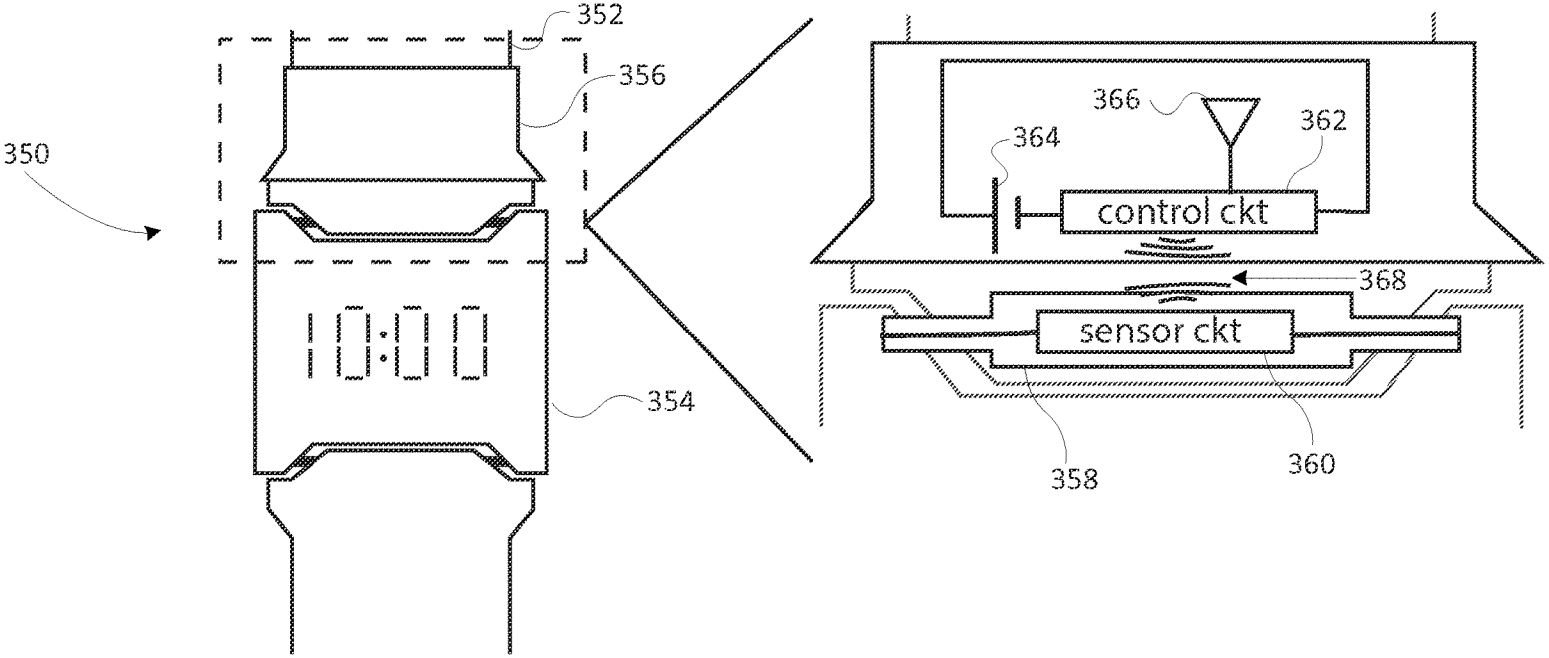
FIG. 3B is an illustration of a modified watch strap in accordance to some example embodiments.

FIG. 3B provides an illustration of a modified watch strap in accordance to some example embodiments. A watch 350 is shown to include a strap 352, a watch body 354, and a strap circuit 356. The watch 350 works similarly to smartwatch 300 except watch 350 encompasses all types of watches beyond smartwatches. A detailed view of watch 350 is shown in FIG. 3B providing a pin 358, sensor circuit 360, power source 364, control circuit 362, antenna 366, and a communication channel 368. Communication channel 368 is provided as a wireless coupling between control circuit 362 and sensor circuit 360. In certain embodiments, the weak point is on pin 358, so when stress is applied, the weak point breaks and the wireless coupling between control circuit 362 and sensor circuit 360 is disturbed. In certain aspects, the coupling between the control circuit 362 and the sensor circuit 358 may be a magnetic coupling. Another implementation may have the coupling between control circuit 362 and sensor circuit 358 as a capacitive coupling. Additionally, control circuit 362 may include a normally open magnetic switch that is closed when the communication channel 368 is disturbed due to pin 358 breaking. In the event pin 358 is broken, control circuit 362 provides a distress signal to another device (a network element 102). In certain aspects, the provided sensing mechanism of FIG. 3B is incorporated in the smartwatch 300 (acting as a composite device 116) and when pin 358 is broken, control circuit 362 activates an emergency protocol. As previously discussed in the analogous embodiment of FIG. 3A, the location of pin 358 and strap circuit 356 may be provided at different parts of a multi-link and multi-pin strap.

Different types of sensors may be incorporated in smartwatch 300 and watch 350. For simplicity in description, smartwatch 300 will be used in reference. In certain aspects, Hall effect sensors may be incorporated in watch body 304 and a magnet in strap 302. When watch pin 306 is compromised and strap 302 separates from watch body 304, the Hall effect sensor notices the removal of the magnetic field. Another sensor that may be incorporated is a simple normally open magnetic switch that closes when watch pin 306 is compromised. Yet another sensor is a spring loaded normally closed switch that closes when the watch pin 306 is compromised. Yet another sensor is a normally open switch that is being monitored with a small amount of electricity such that when the watch pin 306 is compromised, the normally open switch opens and the lack of connectivity is sensed.

Figure 4:
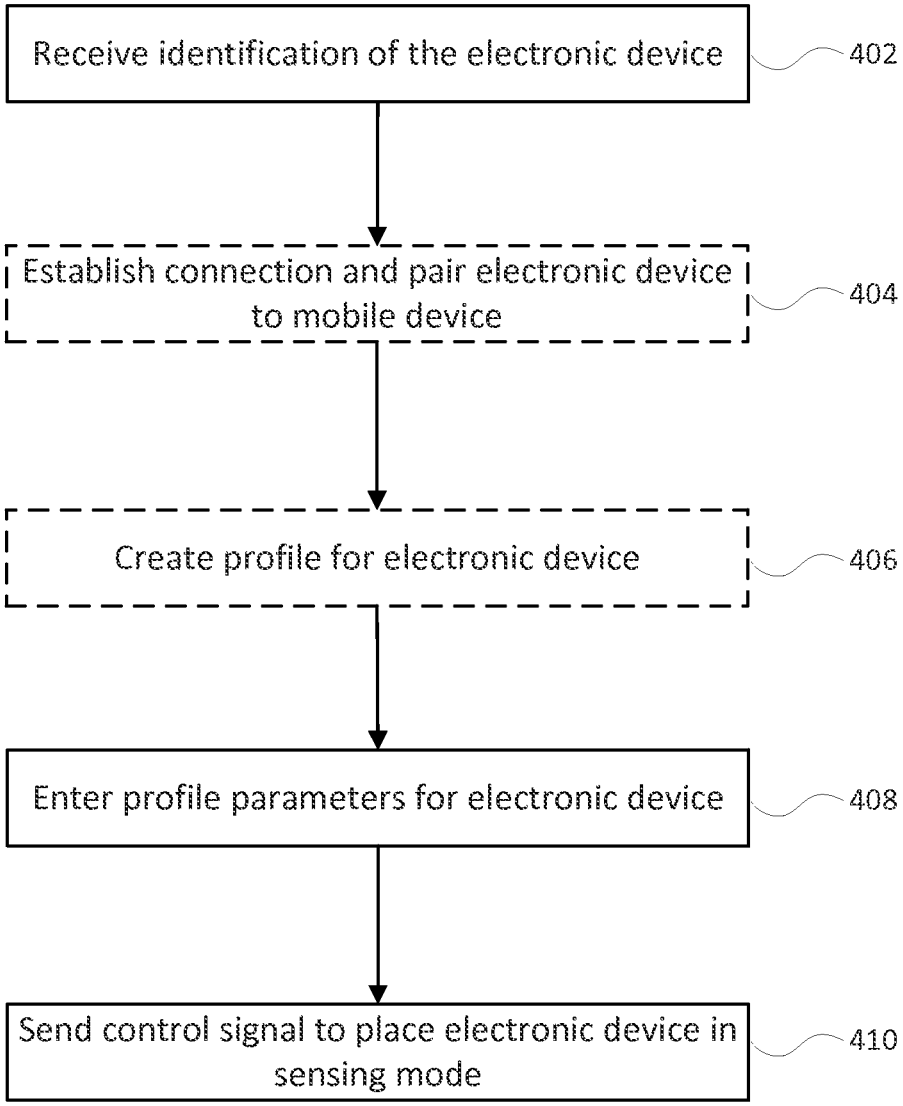
FIG. 4 is a flow diagram in accordance to certain embodiments providing some steps performed by a network element in order to pair the network element with the user device.

FIG. 4 provides a flow diagram in accordance with certain embodiments for pairing network element 102 to a user device 104. For clarity, FIG. 4 depicts a sample pairing of two separate devices where an electronic device corresponds to the user device 104 and a mobile device corresponds to the network element 102.

At step 402, the mobile device receives an identification of the electronic device. The identification may include a broadcast ID, a media access control (MAC) address, or SSID of the electronic device. In certain embodiments, a button or a similar input device is present on the electronic device, and the broadcasting or discoverability of the electronic device stems from a user pressing the button on the electronic device. At step 404, the mobile device establishes a connection with the electronic device and performs a pairing between both devices. At step 406, a profile of the electronic device is created at the mobile device.

At step 408, profile parameters are entered for the electronic device. For example, profile parameters may include a list of numbers or contact devices 114 to call or send a text message to when an emergency protocol is activated. Profile parameters may further include whether or not to record audio and/or video when an emergency protocol is activated. Additionally, profile parameters may include whether or not to take pictures of the surrounding area. In certain embodiments, the mobile device is capable of recognizing faces, and a profile parameter may be set that the mobile device only takes photos containing a human face after an emergency protocol is activated or triggered. In certain aspects, profile parameters may be set where the mobile device only sends pictures taken outside. The mobile device would be able to ascertain locations of photographs through parameters such as a GPS signal, amount and composition of light, the presence of a skyline, etc. Profile parameters may be set where the mobile device avoids sending images that seem worthless, for example, detecting whether an image is all black and concluding that it must be located within a pocket or a bag. Along the same lines, the mobile device may be set to where blurry photos are not sent. In certain aspects, similar profile parameters may be set for audio as well as video recordings. For example, profile parameters may be set where the mobile device does not record silence, but records and sends traffic noise, human voices, etc. The profile parameters provided have used a mobile device (network element 102) as an example, but similar profile parameters may be set where an electronic device (user device 104) or a composite device 116 with processing power and capabilities similar to that of a smartwatch performs the audio, video, and picture captures when an emergency protocol is activated. Additionally, profile parameters pertaining to how location information should be provided may be set. Profile parameters for a password, PIN, or passcode may be set as well. The aforementioned parameters are provided as examples, but other profile parameters may be set as well.

At step 410, a control signal is sent from the mobile device to the electronic device to place the electronic device in a sensing mode. In certain embodiments, the electronic device does not consume power during the sensing mode.

Additionally, the steps in FIG. 4 may apply to a composite device 116 or a smartwatch. When applied to a smartwatch acting as composite device 116, steps 402 and 404 are optional. In addition, profile parameters may be set elsewhere and downloaded to the smartwatch. The profile parameters may be stored at a network location and able to be modified on any device. The smartwatch may refresh parameter settings on a schedule, or the parameters may be pushed to the smartwatch when at least one parameter changes. The push and refresh functionalities may also apply in the case where a mobile phone utilizes a network storage location for storing profile parameters.

Figure 5A:
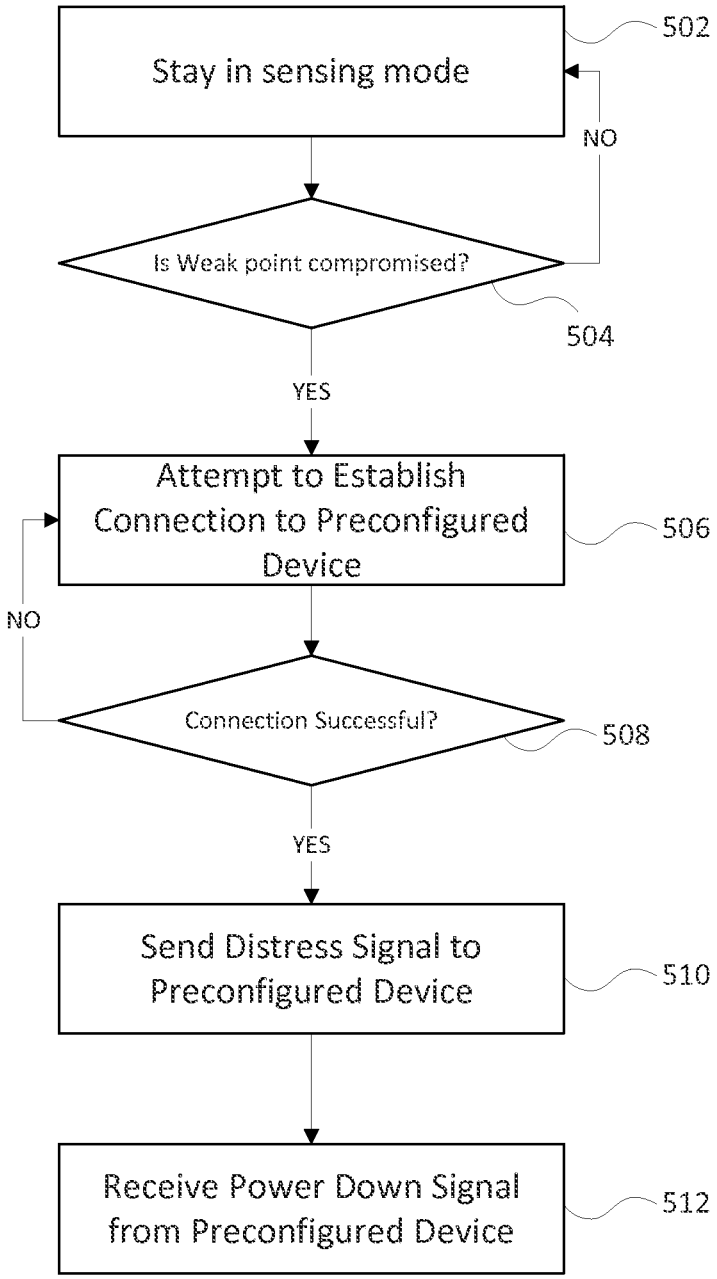
FIG. 5A is a flow diagram for establishing a connection between a user device and a network element over a network according to certain embodiments of the disclosure.

FIG. 5 illustrates several flow diagrams for generating a distress signal by a user device in accordance with some example embodiments. FIG. 5A is a flow diagram for establishing a connection between a user device 104 and a network element 102 over a network 106 according to certain embodiments of the disclosure. In FIG. 5A, network element 102 is described as a preconfigured device to designate a pairing between user device 104 and network element 102. Additionally, the steps in the flow diagram are performed at user device 104. At step 502, user device 104 is in a sensing mode. For example, the sensing mode may be a dormant mode where the user device 104 does not consume any power while monitoring a weak point on the user device 104. At step 504, a decision is made by the user device 104 as to whether the weak point has been compromised or not. In the case the weak point is not compromised, the user device 104 returns to sensing (step 502). In the case the weak point is compromised, the user device 104 attempts to contact the preconfigured device at step 506.

At step 508, the user device 104 determines whether the connection to the preconfigured device is successful. If both the user device 104 and the preconfigured device are not successfully connected to one another, then the user device 104 retries to connect at step 506. In the event, the connection is successful, user device 104 sends a distress signal to the preconfigured device at step 510. In certain aspects of the disclosure, the user device 104 receives a power down signal from the preconfigured device at step 512. The power down signal may be an abort signal from the preconfigured device.

In some embodiments, the power down signal is provided automatically and serves as a notification to the user device 104 that the distress signal has been received.

Figure 5B:
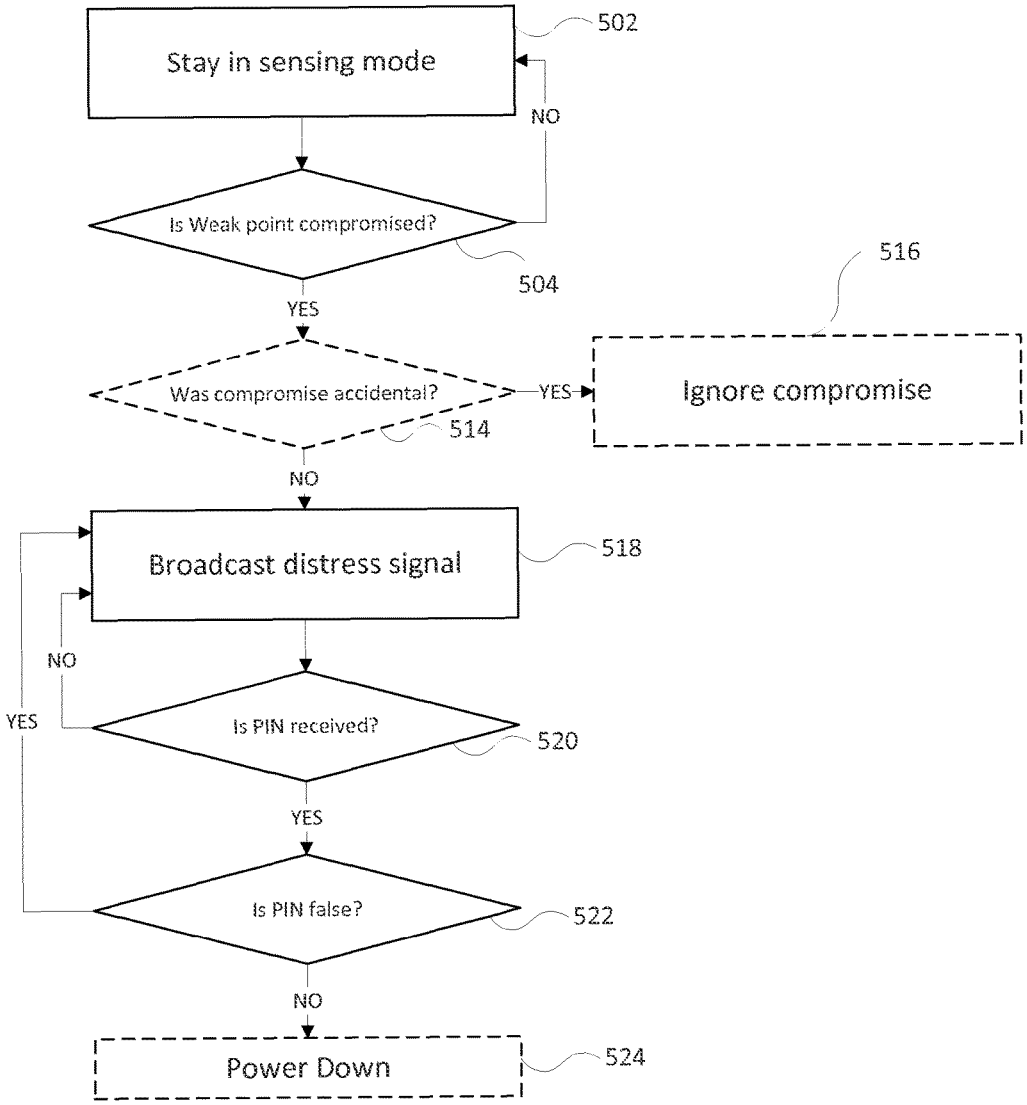
FIG. 5B is a flow diagram in accordance with certain embodiments for generating a distress signal at a user device.

FIG. 5B is a flow diagram in accordance with certain embodiments for generating a distress signal at a user device 104. Steps 502 and 504 are analogous to those described in FIG. 5A. In FIG. 5B, at step 504, when the weak point on user device 104 is compromised, user device 104 determines at step 514 whether the compromise is accidental or not. For example, if user device 104 is an electronic device on a watch strap, the electronic device may include capacitive sensors that sense whether the break in the weak point occurred while the sensors were close to human skin or not. If the break happened close to human skin, this may be interpreted as a watch strap being ripped off of a user's wrist which qualifies as a non-accidental break. At step 514, user device 104 uses available sensors and processing capability to determine whether the break in the weak point was accidental. In the case the break in the weak point was accidental, the break is ignored at step 516, and in the case the break is not accidental, the user device performs step 518. In certain aspects, since the preconfigured device possesses a higher computational capability than user device 104, at step 514, user device 104 sends sensor data for processing at the preconfigured device, and the preconfigured device determines whether the break in the weak point is accidental and notifies user device 104 of the result.

At step 518, user device 104 broadcasts a distress signal on an open channel for any device listening to pick up. In certain embodiments, the distress signal is merely switching from a sensing mode to a discoverable mode where the user device 104 broadcasts its SSID. In certain embodiments, the distress signal is broadcast until the power source on the user device 104 is depleted. In some designs, at step 520, the user device 104 may listen for an indication that a PIN, password, or passcode has been entered. In yet another variation, user device 104 is compatible with multiple passcodes and at step 522 determines whether the PIN or passcode is false. If the PIN or passcode is not a false PIN or passcode, then the user device will power down at step 524 and discontinues broadcasting the distress signal.

In certain embodiments, steps 520 and 522 occur at a network element 102 and user device 104 receives a confirmation of the result of the PIN or passcode being a true PIN or a false PIN. In yet another variation, the user device 104 may be unaware of a PIN or passcode status and just receives a power down signal from the network element 102.

Figure 5C:
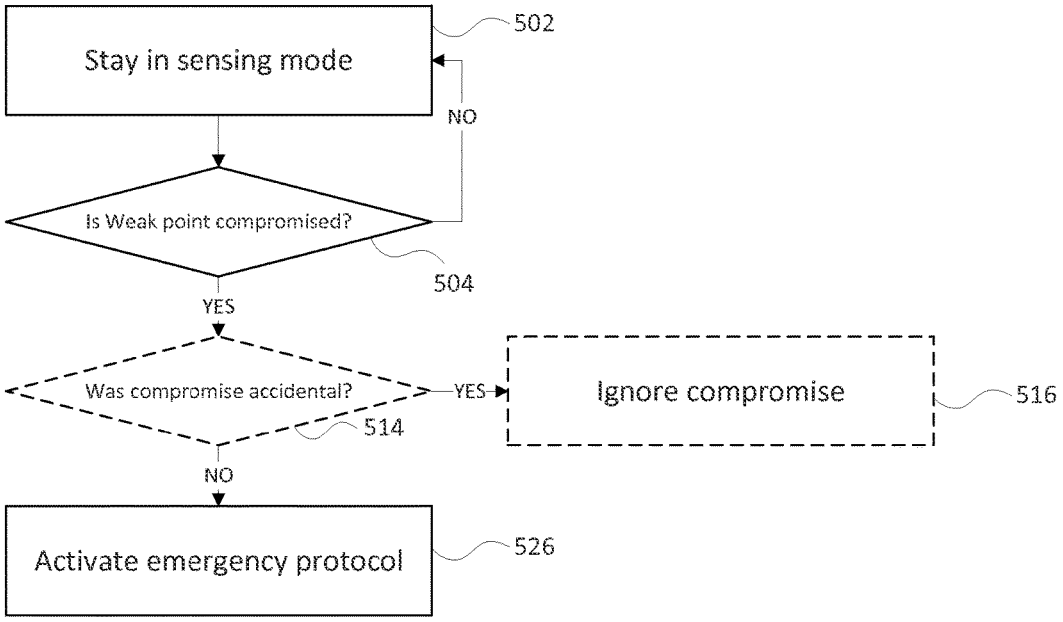
FIG. 5C is a flow diagram in accordance with certain embodiments of the disclosure for activating an emergency protocol at a composite device.

FIG. 5C is a flow diagram in accordance with certain embodiments of the disclosure for activating an emergency protocol at a composite device 116. Since composite device 116 incorporates user device 104, network 106, and network element 102, FIG. 5C does not generate a distress signal as in FIGS. 5A and 5B. Instead, after progressing through steps 502, 504 and 514, the composite device 116 proceeds to activate the emergency protocol in step 526. Non-limiting examples of an emergency protocol are placing a voice or video call to one or more parties, providing an SOS signal to emergency response teams, relaying GPS information to one or more parties, taking pictures of surrounding areas and sending this information to other parties, sending an SMS (Short Message Service) or MMS (Multimedia Messaging Service) message, recording the number of steps moved and providing this information either in addition to or in lieu of GPS information, and broadcasting identification information in order to be discovered by other parties. For example, the network element may broadcast its SSID information in hopes of being discovered by a network monitor 110.

Figure 6:
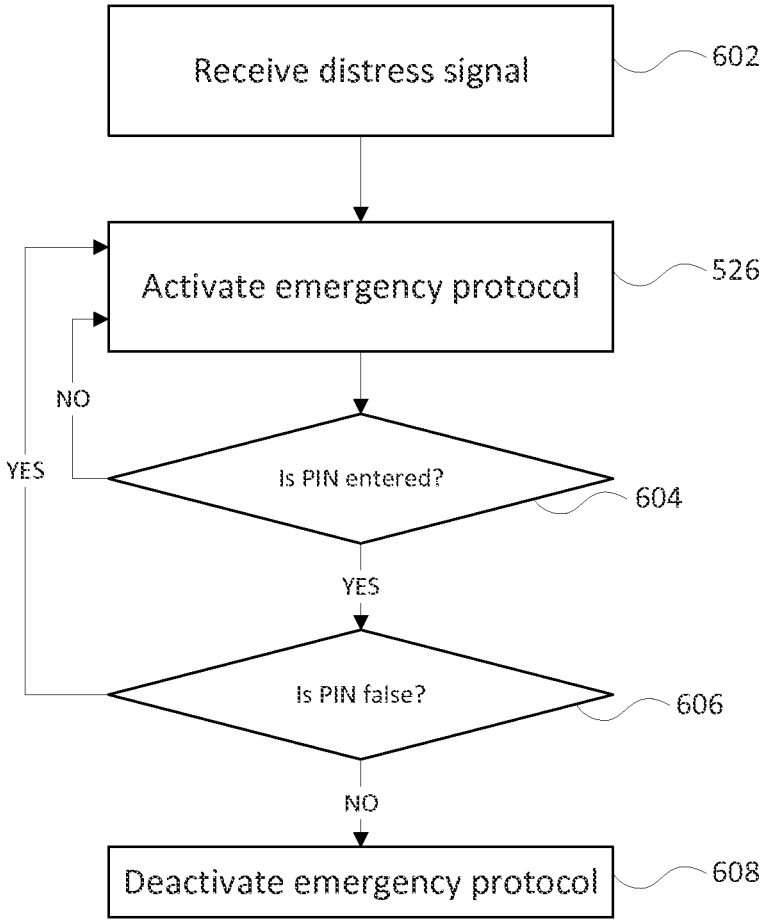
FIG. 6 illustrates a flow diagram for activating an emergency protocol at a composite device in accordance with some example embodiments.

FIG. 6 is a flow diagram in accordance with certain embodiments of the disclosure for activating an emergency protocol at a network element 102. At step 602, network element 102 receives a distress signal from user device 104. At step 526, network element 102 activates an emergency protocol. In certain embodiments, the emergency protocol is constrained to device profile parameters set in FIG. 4. At step 604, network element 102 determines whether a PIN or passcode has been entered. If a PIN has been entered, at step 606, network element 102 determines whether the PIN is false. In the case the PIN is not false, then network element 102 proceeds to deactivate the emergency protocol at step 608. For example, an SMS or MMS message may be provided to already contacted parties that the emergency was a false alarm. In some situations, entering a false PIN may modify the functionality of the network element 102. For example, if network element 102 was actively making a call, the entering of a false PIN will send the call to a background process, making it appear like the emergency protocol has been canceled or deactivated. While in the meantime, the call may be kept active or less palpable methods of reaching out to one or more parties may be ongoing. The preceding example provides a feature where network element 102 is compatible with multiple classes of PINs or passcodes. In the case where there exists a true PIN and a false PIN, when the true PIN is provided, the emergency protocol is deactivated while providing a false PIN gives an illusion that the emergency protocol is deactivated. The value of this false PIN may be set alongside the value of the true PIN in a profile parameter similar to that already discussed. In this example, the false PIN is not a random PIN, but is chosen as a PIN that may be entered, for example, when the user is under duress.

User device 104 and network element 102 have been discussed in the context of smartwatches, watches, smartphone, computers, mobile telephones, PDAs, etc. The disclosure is not limited to these devices. In certain embodiments, the user device 104 may be incorporated as a link or strap to a purse, and when the link breaks, a distress signal is generated. In certain aspects, the user device 104 may be incorporated in other wearable devices such as wristbands, fitness gears, necklaces, bangles, anklets, or other types of jewelry. Additionally, the user device 104 may be incorporated in gewgaws such as key chains, wallet chains, key rings, and trinkets. In certain aspects, user device 104 may be incorporated in a device held on by a band whose primary function is to strap the device to something. Additionally, since user device 104 is incorporated in the band, the band also serves as an external detection mechanism and an alert triggering interface. Hence, the functions served by the band are multiplied by incorporating user device 104. Functionality is further enhanced by pairing user device 104 with network element 102.

In situations in which the systems discussed here collect personal information about opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, a user's identity may be treated so that no personally identifiable information can be determined for the user, or a user's geographic location may be generalized where location information is obtained (such as to a city, ZIP code, or state level), so that a particular location of a user cannot be determined. Thus, the user may have control over how information is collected about the user and used by a content server.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosed embodiments and does not pose a limitation on the scope of the embodiments unless otherwise claimed. No language in the specification should be construed as indicating any non-claimed element as essential to the practice of the embodiments of the disclosure.

Certain embodiments of this invention are described herein. Variations of those embodiments may become apparent to those of ordinary skill in the art upon reading the foregoing description. The inventors expect skilled artisans to employ such variations as appropriate, and the inventors intend for the embodiments to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system comprising:

a smartphone; and a wearable device communicably coupled with the smartphone via a wireless connection the wearable device comprising:

a watch strap;

a watch body;

a watch pin that connects the watch strap to the watch body, wherein the watch pin is a weak point configured to break when an applied stress exceeds a threshold stress level;

a detection circuit configured to determine whether the watch pin is broken; and a transmitter configured to send a distress signal to the smartphone using the wireless connection in response to a signal from the detection circuit indicating that the watch pin is broken, wherein the smartphone is configured to receive the distress signal and, in response to receiving the distress signal, activate an emergency protocol that includes an action taken by the smartphone.

2. The system of claim 1, wherein the emergency protocol comprises placing a call by the network element, recording audio, recording video, recording GPS location, and sounding an alarm.

3. The system of claim 1 further comprising a network monitor, wherein the network monitor is configured to receive the distress signal, and determine a location associated with the distress signal.

4. The system of claim 3, wherein the network monitor is further configured to determine a location associated with the network element and provide the distress signal to the network element.

5. The system of claim 1, wherein a processor of the network element is further configured to deactivate the emergency protocol in response to receiving an abort signal.

6. The system of claim 1, wherein the wireless connection uses protocols that support at least one of ZigBee, Thread, 100 MHz, ultrasonic waves, audible waves, and near field communication.

7. A wearable device comprising:

a watch strap;

a watch body;

a watch pin that connects the watch strap to the watch body, wherein the watch pin is a weak point configured to break when an applied stress exceeds a threshold;

a battery;

a transmitter;

a receiver; and a detection circuit, wherein the detection circuit comprises a sensor circuit and a control circuit and wherein the sensor circuit is coupled to the control circuit, wherein the sensor circuit is configured to detect when the watch pin is broken, wherein the control circuit is configured to activate the transmitter in response to the sensor circuit detecting the break of the watch pin, wherein the transmitter and the receiver are configured to establish a connection to a preconfigured device, and wherein the transmitter is further configured to send a distress signal to the preconfigured device to trigger the preconfigured device to activate an emergency protocol.

8. The wearable device of claim 7, further comprising:

a processor configured to determine a location associated with the device; and wherein the transmitter is further configured to transmit the location to a network monitor.

9. The wearable device of claim 7, further comprising:

an input interface configured to receive an abort signal; and a processor configured to deactivate the distress signal when the abort signal is received.

10. The wearable device of claim 7, wherein the receiver is further configured to receive a power down signal from the preconfigured device.

11. The wearable device of claim 7, wherein the transmitter and the receiver support at least one wireless network protocol selected from the group consisting of: WiFi, ZigBee, Thread, near field communication, 100 MHz, and ultra-wide band.

* * * * *